United States Patent [19]

Smith

[11] 4,425,927

[45] Jan. 17, 1984

[54] COIN SORTING AND COUNTING APPARATUS

[76] Inventor: William J. Smith, 3031 Beauchamp, Dallas, Tex. 75216

[21] Appl. No.: 418,609

[22] Filed: Sep. 16, 1982

[51] Int. Cl.[3] ..... G07D 9/06

[52] U.S. Cl. ..... 133/8 A

[58] Field of Search ..... 133/1 A, 8 A, 1 R, 8 R, 133/8 C, 8 D; 33/125 R, 169 R; 206/81, 84

[56] References Cited

U.S. PATENT DOCUMENTS

| | | | |
|---|---|---|---|
| 1,401,957 | 1/1922 | Boulton | 133/1 A |
| 1,407,140 | 2/1922 | Friesen | 133/1 A |
| 2,215,858 | 9/1940 | Slootsky | 133/1 A X |
| 2,444,804 | 7/1945 | Carruthers | 133/1 A X |
| 3,107,467 | 10/1963 | Gates | 133/8 R X |

*Primary Examiner*—Stanley H. Tollberg
*Attorney, Agent, or Firm*—Peter J. Murphy

[57] ABSTRACT

Apparatus for sorting and counting coins includes at least one tray and a pair of associated scoops. The tray includes a plurality of troughs for receiving and storing stacked coins, consisting of one or more troughs for accommodating quarters or alternatively nickels, and one or more troughs for accommodating pennies or alternatively dimes. The troughs are deep enough to fully receive a stack of associated coins, and dimensioned slightly larger than the larger of the coins to enable use of a scoop to retrieve the coins from the troughs. Each trough has a base end wall, and two indicia lines, spaced from that end wall, to identify stacks of the two denominations of coins for which the trough is designed. The scoops are elongated cylindrical members including a cylindrical handle and a tubular sheath projecting from one end of the handle. The sheath is C-shaped in cross section defining a longitudinal slot from which the interior of the sheath may be viewed, with the slots diverging at the tip end of the sheath to form a scoop or shovel end. The scoops are dimensioned to accommodate two denominations of coins, and the scoops each have two indicia spaced relative to the base end of the sheath defined by the handle, to identify shorter stacks of coins. The sheath may identify a stack of fifty pennies, for example; and the scoop may then be used to transfer that stack directly to a tubular paper wrapper.

15 Claims, 8 Drawing Figures

COIN SORTING AND COUNTING APPARATUS

This invention relates to apparatus for sorting and counting coins; and more particularly to such apparatus for accumulating sorted coins in stacks for the purpose of counting and for the purpose of inserting coins into packaging envelopes.

One object of this invention is to provide a tray for conveniently sorting coins into various denominations.

Another object of this invention is to provide such tray for accumulating such coins in stacks and for identifying a preselected number of stacked coins.

A further object of this invention is to provide a scoop for collecting and transferring stacked coins.

Still another object of this invention is to provide such scoop for accumulating stacks of a smaller preselected number of coins, usable for inserting such stacks into packaging envelopes.

A still further object of this invention is to provide a kit of such trays and scoops wherein assembled trays define a case enclosing the scoops and possibly other articles.

These objects are accomplished in a tray for stacking and counting coins, a scoop for stacking and counting coins, and an assembly of such trays and scoops. Such tray may comprise a base having at least two elongated troughs configured to receive and support a stack of coins, each having means defining a perpendicular base end wall. One of the troughs is dimensioned to receive and support a stack of coins of a first type such as quarters, and to alternatively receive and sort a stack of coins of a second type such as nickels having a smaller diameter. The other trough is dimensioned to receive and support a stack of coins of a third type such as pennies, and to alternatively receive and support a stack of coins of a fourth type such as dimes having a smaller diameter. The one trough has a first indicia spaced from its base end wall to identify a stack of a selected number of quarters disposed in the trough, and has a second indicia spaced from its base end wall to identify a stack of a selected number of nickels disposed in the trough. The other trough has a third indicia spaced from its base end wall to identify a stack of a selected number of pennies disposed in that trough, and has a fourth indicia spaced from its base end wall to identify a stack of a selected number of dimes disposed in that trough. A cover may be configured substantially identical to the base, with the cover and base having coacting aligning means to enable assembly of the cover and base with associated troughs confronting each other to define storage chambers.

At least two scoops are desirably provided for use with such trays. Each scoop comprises an elongated sheath having a cylindrical C-shaped cross section including means forming a base end wall therefor; and each sheath provides a narrow longitudinal slot extending its full length and opening to its interior, the slot diverging widely at the open end of the sheath to define a scoop end for gathering coins. The sheath of one scoop is dimensioned to receive a stack of quarters, and to alternatively receive a stack of nickels. The sheath has a first indicia spaced from its base end wall to identify a stack of a selected number of quarters, and has a second indicia to identify a stack of a selected number of nickels, the indicia being visible through the longitudinal slot. The other scoop includes a sheath dimensioned to receive and identify stacks of pennies or dimes alternatively.

The novel features and the advantages of the invention, as well as additional objects thereof, will be understood more fully from the following description when read in connection with the accompanying drawings.

DRAWINGS

DESCRIPTION OF THE PREFERRED EMBODIMENT

Figure 1:
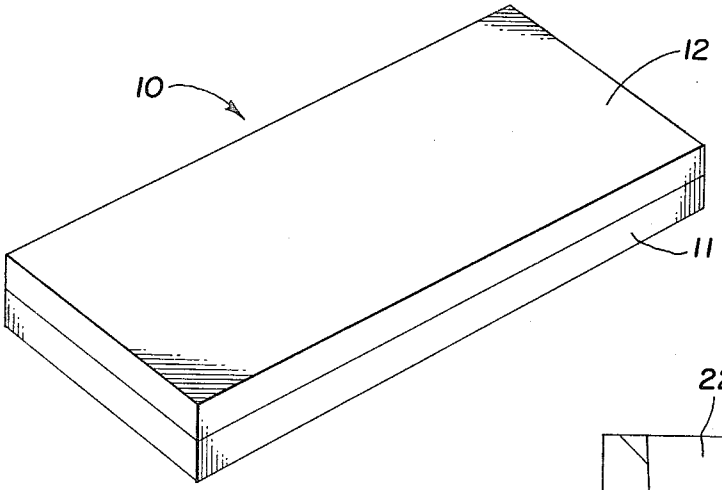
FIG. 1 is a perspective view of apparatus according to the invention.

FIG. 1 is a perspective view of an assembly of two trays, to be described, which are secured together to provide a self-contained case, with the two trays defining chambers for carrying the scoops, to be described, and possibly other items. The two trays are identified as a base tray 11 and a cover tray 12; and the trays may be identical in configuration except, perhaps, that the troughs to be described will be arranged as mirror images of each other. The base tray 11 and the cover tray 12 may be secured together, as an assembly 10, in any desired manner.

Figure 4:
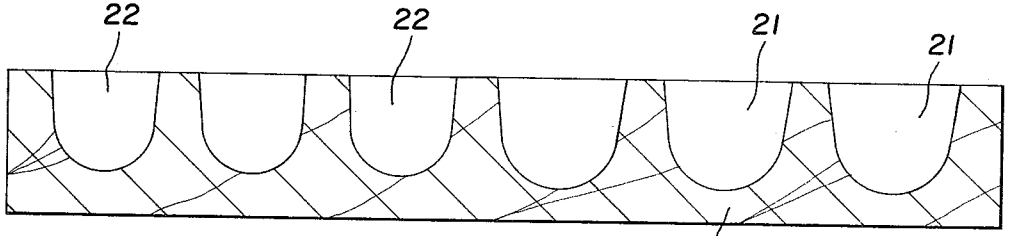
FIG. 4 is a transverse sectional view taken along the line 4—4 of FIG. 2.
Figure 3:
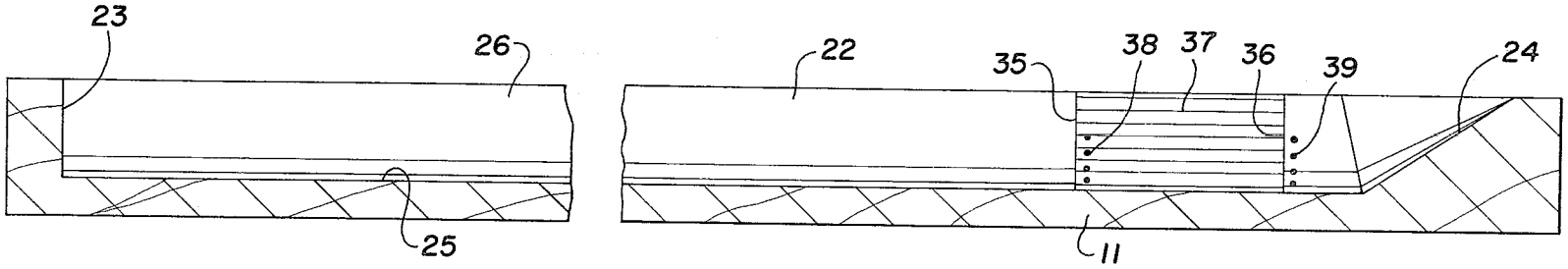
FIG. 3 is a longitudinal sectional view, taken along the line 3—3 of FIG. 2.
Figure 2:
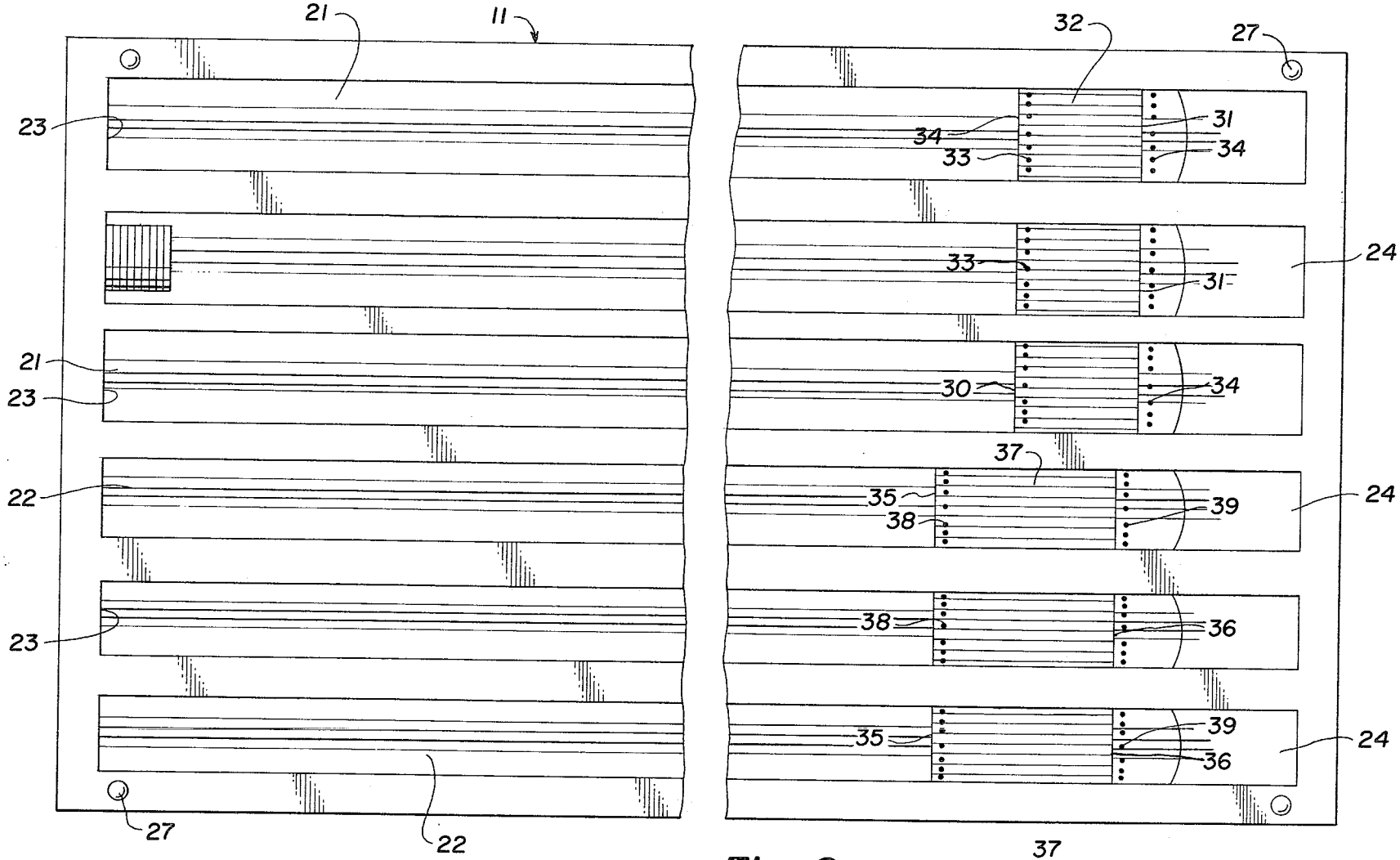
FIG. 2 is a plan view of the open face of a tray according to the invention.

FIGS. 2, 3 and 4 illustrate details of the base tray 11. The tray may be generally rectangular in configuration, and may be fabricated from any suitable material such as wood or plastic. FIG. 2 is a view of the interior face of the tray 11, in which are formed six parallel elongated coin receiving troughs, three of the troughs 21 being sized for example to accommodate quarters or nickels, and three of the troughs 22 being sized for example to accommodate pennies or dimes. In the illustrated preferred form, three adjacent and parallel troughs 21 are disposed at one side of the tray and three parallel and adjacent troughs 22 are disposed at the other side of the tray. A base end wall 23 is formed for each of the troughs, at one end of the tray, this base end wall being perpendicular to the inner face. The end walls 24 for the opposite ends of the grooves are inclined to facilitate the use of the tray as will be described. The troughs are uniform in depth and are generally U-shaped in cross section, as best seen in FIG. 4.

The troughs are slightly greater in depth than the diameter of the larger coin which is to be accommodated in a particular trough. The preferred cross sectional configuration of the trough includes a lower generally semicylindrical base portion 25, formed with a radius slightly than the radius of the larger coin to be accommodated, and an upper portion consisting of side walls 26 which are flared slightly outwardly from the base portion, so that the troughs are wider at the face than at mid-point.

In general, the troughs are configured to facilitate the use of scoops, to be described; and it is for this reason that the diameters of the base portions are larger than the diameters of the larger coins to be accommodated, that the troughs are flared outwardly toward the tops thereof, and that the troughs are provided with the inclined end walls 24. All of these relationships facilitate the use of the scoops, to be described, to remove coins from the troughs.

The troughs 21 are dimensioned to accommodate quarters and nickels; and it will be seen that these troughs are provided with several forms of indicia adjacent to the respective inclined end walls thereof. These indicia include a quarter line 30 and a nickel line 31 provided in the base of the troughs in any suitable manner such as by painting, and a colored field 32 between the lines, presented in any suitable color to assist in locating these lines. The quarter line 30 is located relative to the respective base end wall 23 to identify the length or height of a stack of quarters of a desired number, two hundred fifty for example. Similarly, the nickel line indentifies the length or height of a stack of two hundred fifty nickels. Additional indicia include quarter marks 33 and nickel marks 34; and these are illustrated as rows of painted dots for example disposed adjacent to and on the outboard sides of the respective quarter line and nickel line relative to the base end wall. These indicia marks enable the user to establish that the correct number of coins is placed in the trough, this being the case when the respective indicia marks are visible with the associated indicia line being just visible or possibly just covered by the last coin of the stack. These indicia enable the tray to be used quickly and easily for the purpose of counting the coins.

The troughs 22 are narrower, being dimensioned to accommodate dimes and pennies; and these troughs similarly include a dime line 35 and a penny line 36, and an enclosed colored field 37. Similarly these troughs include a dime mark 38 and a penny mark 39. Again the tray may be dimensioned and the dime and penny marks placed to identify stacks having a length or height of two hundred fifty coins. A tray as illustrated to include six troughs, accommodating two hundred and fifty coin stacks, may have a length of about eighteen inches and a width of about ten inches.

As seen in the drawings, the base tray 12 may be provided with aligning dowel pins 37 adjacent to each of the four corners, to be received in coacting recesses provided in the cover tray 12 for the purpose of aligning the two trays to form the assembly 10.

Figure 7:
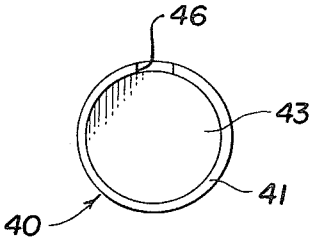
FIG. 7 is a transverse sectional view taken along the line 7—7 of FIG. 6.
Figure 6:
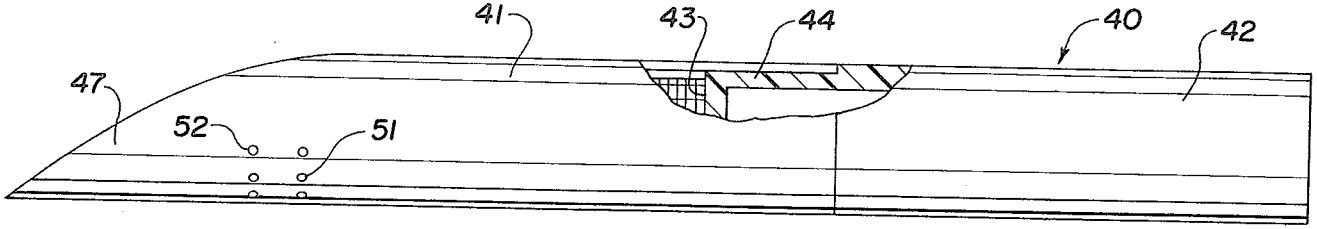
FIG. 6 is a side view, partially broken away, of the scoop of FIG. 5.
Figure 5:
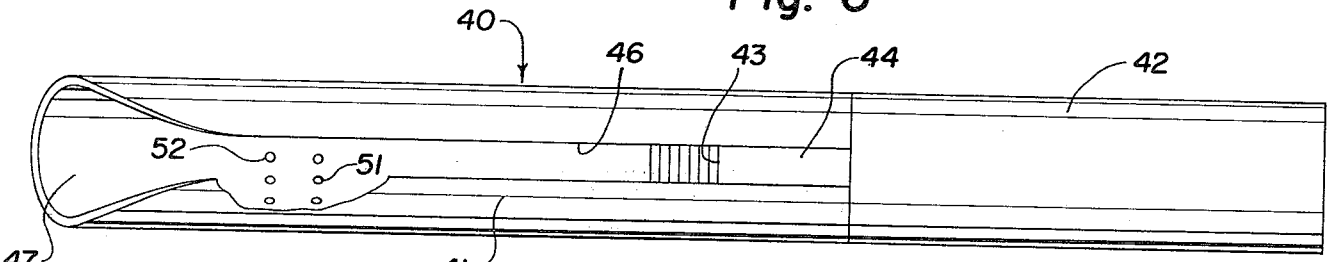
FIG. 5 is a plan view, partially broken away, of a scoop according to the invention.

FIGS. 5, 6 and 7 of the drawing illustrate a preferred form of scoop 40 according to the invention, the scoop consisting of a sheath 41 and a handle 42. The handle 42 may be fabricated from any suitable material. As best seen in FIG. 6 the handle may be fabricated from plastic in the form of a hollow tube having a closed wall 43 at one end. The handle is preferably cylindrical, with the exterior diameter being reduced at the one end to form a nose 44 to be received within an extending portion of the sheath 41.

The sheath 41 is a tubular member formed from a suitable thin walled material such as plastic or metal. The sheath is not completely cylindrical and, when mounted on the handle 42, a longitudinal slot 46 is formed, through which the interior of the sheath may be viewed. The sheath is secured to the nose of the handle in any desired manner, such as by suitable cement, in a manner that the overall diameter of the scoop is generally uniform. As seen in the drawing, at the distal or tip end of the sheath, the confronting edges of the sheath which form the slot 66 diverge outwardly from each other, and the end of the sheath is rounded to define a shovel or scoop end 47 at the tip end of the sheath.

The handle end wall 43 defines a base end wall for the sheath; and this base end wall is a reference for providing stock indicia 51 and 52 adjacent to the scoop end 47.

The illustrated scoop 40 may be dimensioned to accommodate quarters and nickels for example; and accordingly the inner diameter of the sheath may be slightly larger than the diameter of a quarter. The indicia 51 then may be a quarter indicia to identify the length or height of a stack of fifty quarters, while the indicia 52 is a nickel indicia to identify the length or height of a stack of fifty nickels. As illustrated, these indicia may be preferably in the form of rows of holes or perforations provided in the material of the sheath 41, which indicia will be clearly visible when viewed through the slot 46 and the scoop is appropriately held relative to a light source.

A similar scoop configured for use with pennies and dimes may be identical in construction with altered dimensions.

Figure 8:
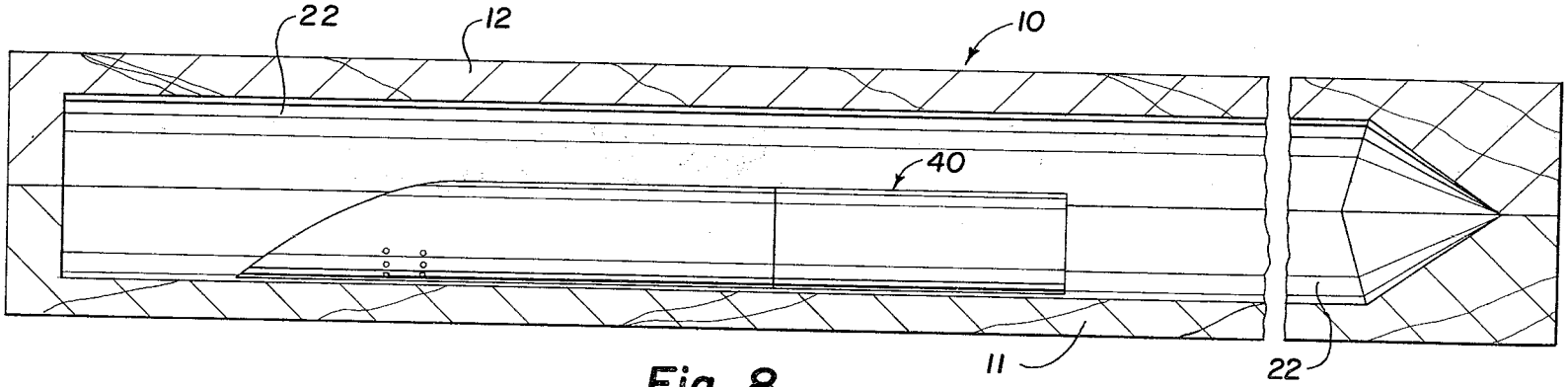
FIG. 8 is a longitudinal sectional view of the assembly of FIG. 1, based on FIGS. 3 and 6.

The scoops 40 of course are configured for use with the trays 11 and 12; and FIG. 8 of the drawing is a longitudinal sectional view of the assembly 10, illustrating how scoops may be stored within the chambers formed by the confronting troughs within the assembly 10, when the apparatus is not in use.

The convenience of use of the described apparatus will be apparent from the foregoing. A desirable form of kit may consist of the two tray assembly 10 illustrated in FIGS. 1 and 8 and possibly four scoops 40, including two scoops of each size. The apparatus is useful for many persons who accumulate large quantities of coins, particularly small businessmen such as street vendors and the like. Where a large number of coins are to be counted or packaged, the apparatus is well adapted for use by two persons, one person using the base tray to sort and stack quarters and nickels for example, and the other using the cover tray to sort and stack pennies and dimes for example. The trays may be used for counting the coins, where a sufficient number of coins are accumulated to fill the troughs 21 and 22; and the associated scoops 40 may then be used to conveniently transfer the counted coins from the troughs to desired bags or other containers.

Where the coins are to be packaged in the conventional tubular paper wrappers, the scoops 40 are conveniently used to gather the desired number of coins from the associated troughs, to measure by means of the scoop the desired number of coins such as fifty pennies, and for transferring the stack of coins from the scoop directly into the paper tube.

What has been described is unique and convenient apparatus particularly suitable for use by a small independent business man, for sorting and counting coins. A feature of the trays is the indicia provided for readily identifying stacks of a selected number of coins for counting purposes. Another feature of the trays is the assembly of two trays into a convenient self-contained carrying case which also provides chambers for carrying the associated scoops.

A feature of the scoops is the configuration enabling convenient use to transfer coins from the associated trays into desired storage containers; and also the feature of very conveniently measuring smaller stacks of coins for insertion directly into conventional paper tube packages.

While the preferred embodiment of the invention has been illustrated and described, it will be understood by those skilled in the art that changes and modifications may be resorted to without departing from the spirit and scope of the invention.

What is claimed is:

1. A tray for stacking and counting coins comprising:

a base having at least one elongated trough configured to receive and support a stack of coins; said trough having means defining a base end wall;

said trough being dimensioned to receive and support a stack of coins of a first type having a first diameter, and to alternatively receive and support a stack of coins of a second type having a second smaller diameter;

said trough having a first indicia spaced from its base end wall to identify a stack of a selected number of said first type coins when disposed in said trough, and having a second indicia spaced from its base end wall to identify a stack of a selected number of said second type coins when disposed in said trough;

said indicia for each trough including means defining a first line indicating the length of the shorter associated coin stack, and means defining a second line indicating the length of the longer associated coin stack;

said indicia for each trough further including a line of visible marks paralleling closely each of said indicia lines, and being disposed on the outboard sides of said indicia lines relative to the base end wall of the trough.

2. A tray as set forth in claim 1 said base having at least two of said elongated troughs;

one of said troughs being dimensioned to receive and support a stack of coins of a first type having a first diameter, and to alternatively receive and support a stack of coins of a second type having a second smaller diameter; the other of said troughs being dimensioned to receive and support a stack of coins of a third type having a third diameter, and to alternatively receive and support a stack of coins of a fourth type having a fourth smaller diameter;

said one trough having a first indicia spaced from its base end wall to identify a stack of a selected number of said first type coins when disposed in said trough, and having a second indicia spaced from its base end wall to identify a stack of a selected number of said second type coins when disposed in said trough; said other trough having a third indicia spaced from its base end wall to identify a stack of a selected number of said third type coins when disposed in said trough, and having a fourth indicia spaced from its base end wall to identify a stack of a selected number of said fourth type coins when disposed in said trough.

3. A tray as set forth in claim 2 said first and second type coins being quarters and nickels respectively; and said third and fourth type coins being pennies and dimes respectively.

4. A tray as set forth in claim 1 a cover configured substantially identically to said base; and said cover and said base having coacting aligning means to enable the assembly of said cover and said base with associated troughs disposed in confronting relation, whereby the pairs of confronting troughs define storage chambers.

5. A tray as set forth in claim 1 each trough having a cross section including a generally semi-cylindrical base portion having a diameter slightly greater than the diameter of the larger associated coin type, and having an upper portion formed by side walls flared outwardly slightly from said base portion.

6. A tray as set forth in claim 1 said indicia for each trough further including a visible field between said first and second indicia lines.

7. A tray as set forth in claim 5 each trough having a depth at least as great as the diameter of the larger associated coin type.

8. A scoop, for use in association with a coin storage trough, for stacking and counting coins comprising an elongated sheath having a cylindrical C-shaped cross section, including means forming a base end wall therefor;

said sheath providing a longitudinal slot extending along its length and opening to its interior; said slot diverging at the open end of said sheath, whereby said open end defines a scoop end for gathering coins;

said sheath being dimensioned to receive a stack of coins of a first type having a first diameter, and to alternatively receive a stack of coins of a second type having a second smaller diameter;

said sheath having a first indicia spaced from its base end wall to identify a stack of a selected number of said first said first type coins when disposed in said sheath, and having a second indicia spaced from its base end wall to identify a stack of a selected number of second type coins when disposed in said sheath; said first and second indicia being visible through said longitudinal slot.

9. A scoop as set forth in claim 8 said sheath being fabricated from a rigid, thin walled material.

10. A scoop as set forth in claim 8 each of said indicia comprising a row of holes penetrating the sheath wall.

11. A scoop as set forth in claim 8 each of said first and second indicia comprising a row of prominently visible marks.

12. A scoop as set forth in claim 8 said scoop having a uniform exterior diameter slightly larger than the diameter of the associated first type coin.

13. A scoop as set forth in claim 8 an elongated handle mounted in alignment with said sheath; said handle forming said base end wall therefor.

14. Apparatus for stacking and counting coins comprising:

a tray having at least two elongated troughs, each having means defining a base end wall;

one of said troughs being dimensioned to receive and support a stack of coins of a first type having a first diameter, and to alternatively receive and support a stack of coins of a second type having a second smaller diameter; the other of said troughs being dimensioned to receive and support a stack of coins of a third type having a third diameter, and to alternatively receive and support a stack of coins of a fourth type having a fourth smaller diameter;

said one trough having a first indicia spaced from its base end wall to identify a stack of a selected number of said first type coins when disposed in said trough, and having a second indicia spaced from its base end wall to identify a stack of a selected number of said second type coins when disposed in said trough; said other trough having a third indicia spaced from its base end wall to identify a stack of a selected number of said third type coins when disposed in said trough, and having a fourth indicia spaced from its base end wall to identify a stack of a selected number of said fourth type coins when disposed in said trough;

at least two scoops, for use in association with said tray; each scoop comprising an elongated sheath having a cylindrical C-shaped cross section, including means forming a base end wall therefor; said sheath providing a longitudinal slot extending along its length and opening to its interior; said slot diverging at the open end of said sheath, whereby said open end defines a scoop end for gathering coins;

said sheath for one of said scoops being dimensioned to receive a stack of coins of said first type, and to alternatively receive a stack of coins of said second type; said sheath of said other scoop being dimensioned to receive a stack of coins of said third type, and to alternatively receive a stack of coins of said fourth type;

said sheath of said one scoop having a first indicia spaced from its base end wall to identify a stack of a selected number of said first type coins when disposed in said sheath, and having a second indicia spaced from its base end wall to identify a stack of a selected number of second type coins when disposed in said sheath; said sheath of said other scoop having a third indicia spaced from its base end wall to identify a stack of a selected number of said third type coins when disposed in said sheath, and having a fourth indicia spaced from its base end wall to identify a stack of a selected number of fourth type coins when disposed in said sheath.

15. Apparatus as set forth in claim 14 said one tray comprising a base tray;

an additional cover tray configured substantially identically to said base tray; and said base tray and said cover tray having coacting aligning means to enable the assembly of said base tray and said cover tray with associated troughs disposed in confronting relation, whereby the pairs of confronting troughs define storage chambers.

* * * * *